US011590764B2

(12) United States Patent
Yamashita et al.

(10) Patent No.: US 11,590,764 B2
(45) Date of Patent: Feb. 28, 2023

(54) PRINTING APPARATUS AND PRINTING METHOD FOR SUPPRESSING CONTAMINATION ON RECORDING MEDIUM

(71) Applicant: SCREEN HOLDINGS CO., LTD., Kyoto (JP)

(72) Inventors: Shinsuke Yamashita, Kyoto (JP); Hiroyuki Kajiya, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 17/399,835

(22) Filed: Aug. 11, 2021

(65) Prior Publication Data

US 2022/0088938 A1 Mar. 24, 2022

(30) Foreign Application Priority Data

Sep. 18, 2020 (JP) ..... JP2020-156965

(51) Int. Cl.

| | |
|---|---|
| ***B41J 2/185*** | (2006.01) |
| ***B41J 15/04*** | (2006.01) |
| ***B41J 29/02*** | (2006.01) |
| ***B41J 29/13*** | (2006.01) |
| *B41J 2/17* | (2006.01) |

(52) U.S. Cl.

CPC ..... *B41J 2/185* (2013.01); *B41J 15/048* (2013.01); *B41J 29/02* (2013.01); *B41J 29/13* (2013.01); *B41J 2/1714* (2013.01); *B41J 15/04* (2013.01); *B41J 2002/1853* (2013.01)

(58) Field of Classification Search

CPC .. B41J 2/185; B41J 15/048; B41J 2002/1853; B41J 29/02; B41J 29/13; B41J 15/04; B41J 2/1714

See application file for complete search history.

(56) References Cited

U.S. PATENT DOCUMENTS

| | | | |
|---|---|---|---|
| 9,079,407 | B2 | 7/2015 | Iwasa |
| 2011/0227999 | A1 | 9/2011 | Tachibana |
| 2012/0249665 | A1 | 10/2012 | Utsugi et al. |
| 2015/0165771 | A1 | 6/2015 | Iwasa |
| 2017/0225470 | A1* | 8/2017 | Goto ..... B41J 2/165 |

FOREIGN PATENT DOCUMENTS

JP 2015-112829 A 6/2015

OTHER PUBLICATIONS

Extended European Search Report issued in corresponding European Patent Application No. 21197419.1-1017, dated Jan. 19, 2022.

* cited by examiner

*Primary Examiner* — Henok D Legesse

(74) *Attorney, Agent, or Firm* — McDermott Will & Emery LLP

(57) ABSTRACT

An image is printed on the front surface M1 by discharging the inks to the front surface M from the discharge heads 321 (first head) facing the front surface M1 (recording surface) of the printing medium M from above. Thus, the inks discharged from the discharge heads 321 partially become mist to possibly produce ink mist. Accordingly, the ink cover 51 (first cover) is arranged between the discharge heads 321 and the front surface M1 of the printing medium M before the discharge heads 321 discharges the inks to the printing medium M. By providing the ink cover 51 for the front surface M1 of the printing medium M before printing in this way, the adhesion of the ink mist to this front surface M1 can be suppressed.

13 Claims, 3 Drawing Sheets

PRINTING APPARATUS AND PRINTING METHOD FOR SUPPRESSING CONTAMINATION ON RECORDING MEDIUM

CROSS REFERENCE TO RELATED APPLICATION

The disclosure of Japanese Patent Application No. 2020-156965 filed on Sep. 18, 2020 including specification, drawings and claims is incorporated herein by reference in its entirety.

BACKGROUND OF THE INVENTION

1. Field of the Invention

This invention relates to a printing technique for performing printing by discharging an ink to a printing medium.

2. Description of the Related Art

As pointed out, for example, in JP 2015-112829A, it is known that part of an ink discharged from a head becomes mist to produce ink mist (ink in a mist state) in a printing apparatus in which the ink is discharged from the head in an ink-jet method. There have been cases where each component of a printing apparatus is contaminated by ink mist if such ink mist is diffused. Accordingly, a mechanism for sucking/collecting ink mist is proposed in JP 2015-112829A.

SUMMARY OF THE INVENTION

The ink mist adheres not only to each component of the printing apparatus, but also to a printing medium. Such a printing medium has a recording surface, on which an image is to be printed, and a non-recording surface opposite to the recording surface. On the other hand, if the recording surface is contaminated before image is printed on the recording surface, a satisfactory image cannot be printed on the recording surface.

This invention was developed in view of the above problem and aims to suppress the contamination of a recording surface of a printing medium with ink mist before printing in a printing technique for performing printing by discharging an ink to the recording surface of the printing medium.

A printing apparatus according to the invention, comprises: a conveyor which conveys a printing medium in the form of a long strip having a recording surface and a non-recording surface opposite to the recording surface; a first head facing the recording surface of the printing medium being conveyed by the conveyor from above, the first head discharging an ink to the recording surface; and a first cover arranged between the recording surface of the printing medium being conveyed by the conveyor before the first head discharges the ink to the printing medium and the first head.

A printing method according to the invention, comprises: conveying a printing medium in the form of a long strip having a recording surface and a non-recording surface opposite to the recording surface; and discharging an ink to the recording surface from a first head facing the recording surface of the printing medium from above, a first cover being arranged between the recording surface of the printing medium before the first head discharging the ink to the printing medium and the first head.

In the invention (printing apparatus and printing method) thus configured, an image is printed on the recording surface by discharging the ink to the recording surface from the first head facing the recording surface of the printing medium from above. Thus, as described above, part of the ink discharged from the first head becomes mist to possibly produce ink mist. Accordingly, in the invention, the first cover is arranged between the recording surface of the printing medium before the first head discharges the ink to the printing medium. By providing the first cover for the recording surface of the printing medium before printing in this way, the adhesion of the ink mist to this recording surface can be suppressed. In this way, the contamination of the recording surface of the printing medium before printing with the ink mist can be suppressed.

As described above, according to the invention, the contamination of a recording surface of a printing medium before printing with ink mist can be suppressed in a printing technique for performing printing by discharging an ink to the recording surface of the printing medium.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 1:
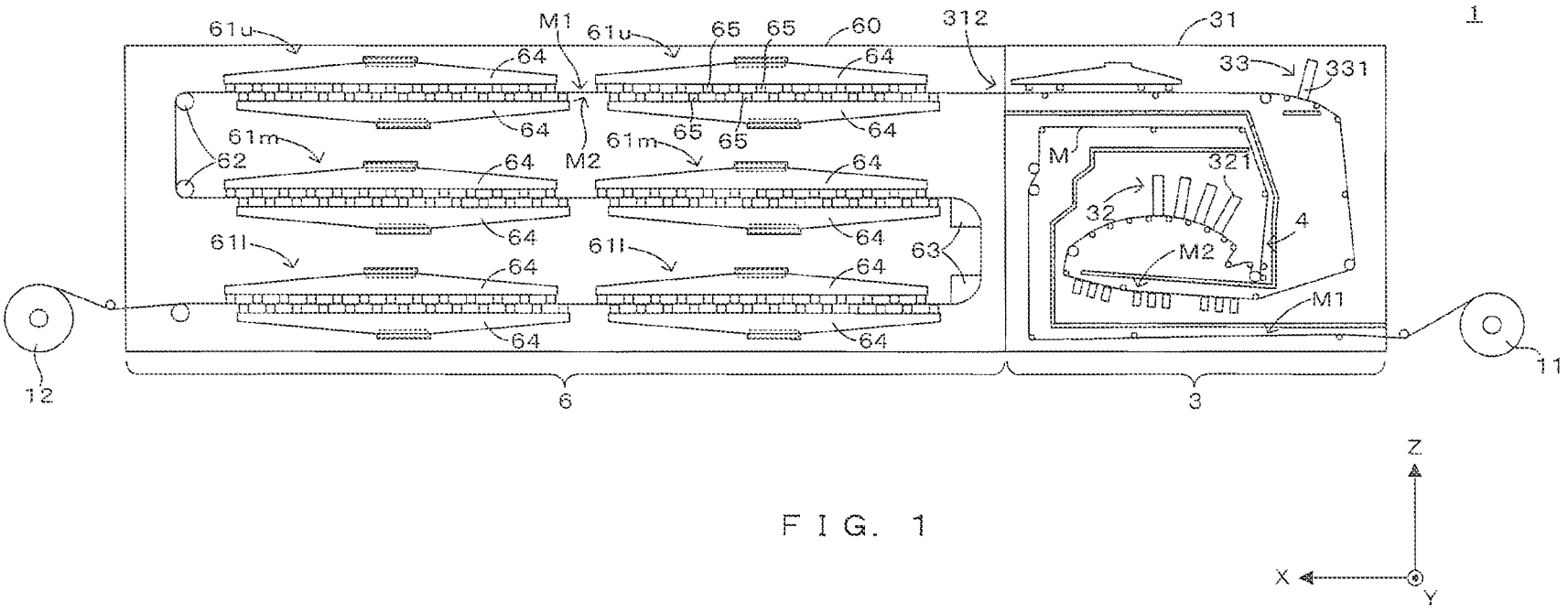
FIG. 1 is a front view schematically showing an example of a printing system provided with a printing apparatus according to the invention.

FIG. 1 is a front view schematically showing an example of a printing system provided with a printing apparatus according to the invention. In FIG. 1 and subsequent figures, an X direction, which is a horizontal direction, a Y direction, which is a horizontal direction orthogonal to the X direction, and a Z direction, which is a vertical direction, are shown as appropriate. A printing system 1 applies printing and drying to a printing medium M while conveying the printing medium M in a roll-to-roll manner by winding the printing medium M fed from a feeding roller 11 by a winding roller 12. Various materials such as paper and films can be utilized as the printing medium M, and the printing medium M has a front surface M1 and a back surface M2 opposite to the front surface M1. The printing system 1 includes a printing apparatus 3 and a drying apparatus 6 between the feeding roller 11 and the winding roller 12, and the printing medium M passes through the drying apparatus 6 after passing through the printing apparatus 3.

As described in detail later, the printing apparatus 3 prints an image on the front surface M1 of the printing medium M by causing water-based inks discharged in an ink-jet method to land on the front surface M1 of the printing medium M. However, the type of the inks to be discharged in the printing apparatus 3 is not limited to the water-based inks.

The drying apparatus 6 includes a drying furnace 60 and dries the printing medium M carried out from the printing apparatus 3 and passing through the drying furnace 60. The drying apparatus 6 includes two blower units 61*u*, two blower units 61*m* and two blower units 611 respectively arrayed in an upper stage, a middle stage and a lower stage in the drying furnace 60. That is, the two blower units 61*u* are arrayed in the X direction in the upper stage, the two blower units 61*m* are arrayed in the X direction in the middle stage below the upper stage, and the two blower units 611 are arrayed in the X direction in the lower stage below the middle stage.

The printing medium M is turned by a pair of rollers 62 after passing through the two blower units 61*u* in the upper stage and passes through the two blower units 61*m* in the middle stage. Further, after passing through the two blower units 61*m* in the middle stage, the printing medium M is turned by a pair of air turn bars 63 and passes through the two blower units 611 in the lower stage. In this way, the printing medium M passes through the blower units 61*u*, 61*m* and 611 in the upper, middle and lower stages in parallel to the X direction. At this time, the front surface M1 of the printing medium M passing through the blower units 61*u* in the upper stage is facing upward and the back surface M2 is facing downward. The front surface M1 of the printing medium M passing through the blower units 61*m* in the middle stage is facing downward and the back surface M2 is facing upward. The front surface M1 of the printing medium M passing through the blower units 611 in the lower stage is facing upward and the back surface M2 is facing downward. Further, each roller 62 turns the printing medium M while supporting the back surface M2 of the printing medium M, and each air turn bar 63 turns the printing medium M while supporting the front surface M1 of the printing medium M.

Each blower unit 61*u*, 61*m*, 611 includes blower chambers 64. The blower chamber 64 includes a plurality of nozzles 65 arrayed in a conveying direction of the printing medium M and injects hot air, which a wind of air of 60° C. or higher, from the nozzles 65 to the printing medium M. Two vertically arranged blower chambers 64 constitute a pair, and the printing medium M passes between these blower chambers 64. That is, the upper blower chamber 64 injects the hot air to the printing medium M passing therebelow, and the lower blower chamber 64 injects the hot air to the printing medium passing thereabove. Note that a plurality of rollers arrayed in the X direction may be provided instead of the lower blower chamber 64 in the blower unit 61*u* on the side of the printing apparatus 3, through which the printing medium M first passes, out of the two blower units 61*u* in the upper stage. In such a configuration, the back surface M2 of the printing medium M carried into the drying apparatus 6 from the printing apparatus 3 can be supported from below by the plurality of rollers.

Figure 2:
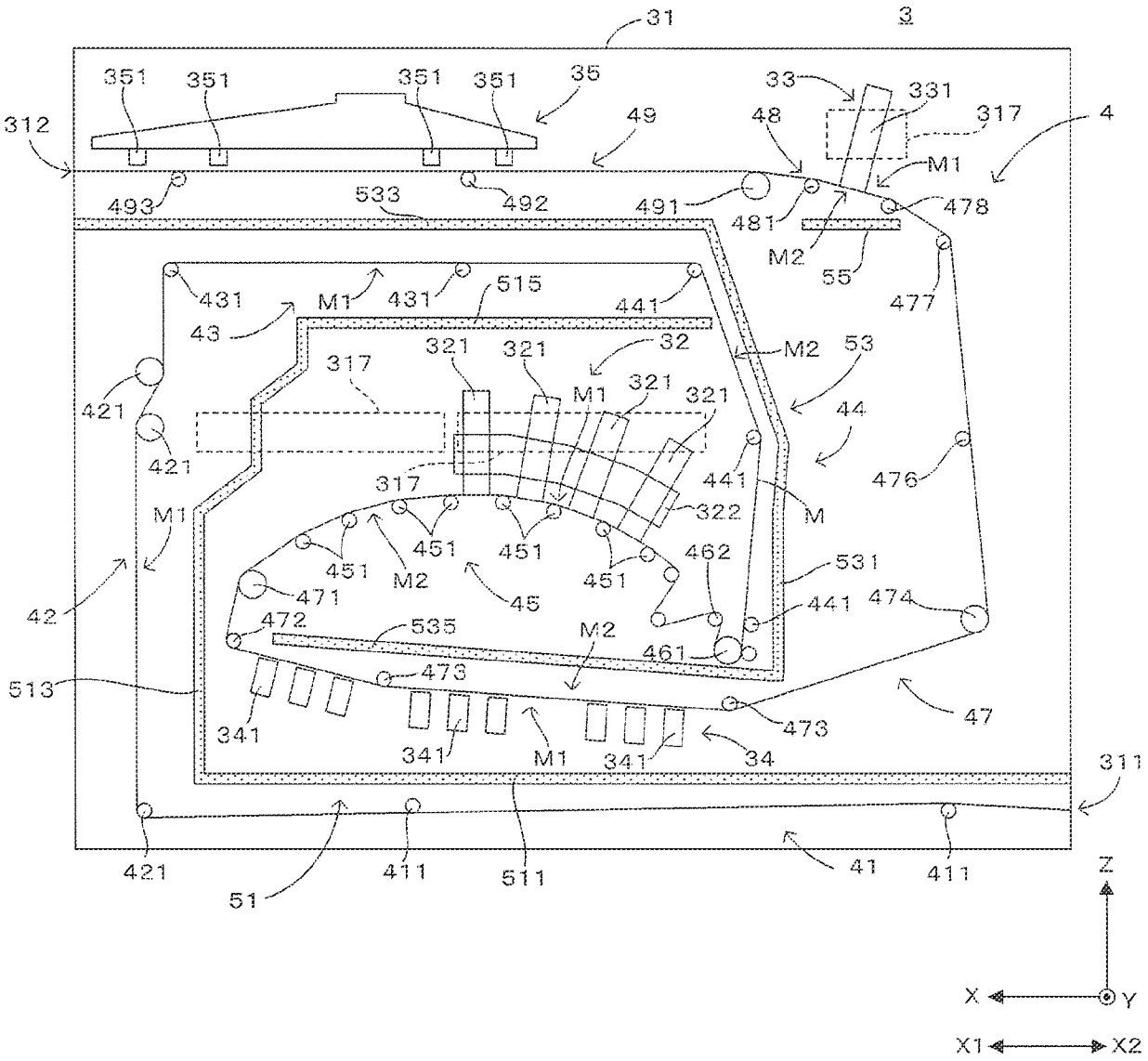
FIG. 2 is a front view schematically showing the printing apparatus according to the invention.

FIG. 2 is a front view schematically showing the printing apparatus according to the invention. In FIG. 2 and subsequent figures, one side X1 and other side X2 in the X direction are shown as appropriate. Here, the one side X1 is a side from the printing apparatus 3 toward the drying apparatus 6, and the other side X2 is a side opposite to the one side X1. The printing apparatus 3 includes a housing 31, a color printing unit 32 arranged in the housing 31, a white printing unit 33 arranged above the color printing unit 32 in the housing 31, and a conveyor 4 which conveys the printing medium M by a plurality of rollers arranged in the housing 31. This housing 31 supports the color printing unit 32, the white printing unit 33 and the respective rollers of the conveyor 4 inside.

The color printing unit 32 includes a plurality of (four) discharge heads 321 arrayed in a moving direction (direction from the other side X2 toward the one side X1) of the printing medium M above the printing medium M being conveyed by the conveyor 4. Further, a support frame 322 is provided for the color printing unit 32, and the plurality of discharge heads 321 of the color printing unit 32 are supported by the support frame 322. The plurality of discharge heads 321 include nozzles facing the front surface M1 of the printing medium M passing therebelow from above, and discharge color inks having mutually different colors from the nozzle by the ink-jet method. Here, the color inks mean inks other than that having a white color and include inks of cyan, magenta, yellow, black and the like. In this way, the plurality of discharge heads 321 of the color printing unit 32 print a color image on the front surface M1 of the printing medium M by discharging the color inks to the front surface M1 of the printing medium M passing therebelow from above.

Further, the white printing unit 33 includes a single discharge head 331 arranged above the printing medium M being conveyed by the conveyor 4. The discharge head 331 includes a nozzle facing the front surface M1 of the printing medium M passing therebelow from above, and discharges a white ink from the nozzle by in the ink-jet method. In this way, the discharge head 331 of the white printing unit 33 prints a white image on the front surface M1 of the printing medium M by discharging the white ink to the front surface M1 of the printing medium M passing therebelow from above.

A carry-in port 311 is open in a side wall on the other side X2 of the housing 31, and the printing medium M is carried into the housing 31 through the carry-in port 311. In contrast, the conveyor 4 includes a carry-in part 41. The carry-in part 41 includes a plurality of rollers 411 arrayed in the horizontal direction X below the color printing unit 32, and conveys the printing medium M carried in through the carry-in port 311 from the other side X2 toward the one side X1 while supporting the printing medium M by the plurality of rollers 411.

Further, the conveyor 4 includes an ascending conveyor 42 provided on the one side X1 of the carry-in part 41. The ascending conveyor 42 includes a plurality of rollers 421 arrayed in the vertical direction Z on the one side X1 of the color printing unit 32. This ascending conveyor 42 conveys the printing medium M upward while supporting the printing medium M by the plurality of rollers 421 after the moving direction of the printing medium M is changed from a direction toward the one side X1 to an upward direction by bending the printing medium M conveyed by the carry-in part 41 upward by the roller 421 located on a lower end, out of the plurality of rollers 421. In this way, the printing medium M is conveyed from the lower side of the color printing unit 32 to the upper side of the color printing unit 32 by the ascending conveyor 42.

Further, the conveyor 4 includes an upper conveyor 43 provided above the color printing unit 32. The upper conveyor 43 includes a plurality of rollers 431 arrayed in the horizontal direction X above the color printing unit 32. This upper conveyor 43 conveys the printing medium M toward the other side X2 while supporting the printing medium M by the plurality of rollers 431 after the moving direction of the printing medium M is changed from the upward direction to a direction toward the other side X2 by bending the printing medium M conveyed from the ascending conveyor 42 toward the other side X2 by the roller 431 located on an end of the one side X1, out of the plurality of rollers 431.

Further, the conveyor 4 includes a descending conveyor 44 provided on the other side X2 of the upper conveyor 43. The descending conveyor 44 includes a plurality of rollers 441 arrayed in the vertical direction Z on the other side X2 of the color printing unit 32. This descending conveyor 44 conveys the printing medium M downward while supporting the printing medium M by the plurality of rollers 441 after the moving direction of the printing medium M is changed from the direction toward the other side X2 to a downward direction by bending the printing medium M conveyed from the upper conveyor 43 downward by the roller 441 on an upper end, out of the plurality of rollers 441. Out of the plurality of rollers 441 of this descending conveyor 44, the roller 441 on the upper end is located above each discharge head 321 of the color printing unit 32, and the roller 441 on a lower end is located below each discharge head 321 of the color printing unit 32. That is, the descending conveyor 44 conveys the printing medium M from an upper side of the color printing unit 32 to a lower side of the color printing unit 32.

Further, the conveyor 4 includes a color conveyor 45 provided below the upper conveyor 43 and on the one side X1 of the descending conveyor 44. This color conveyor 45 includes a plurality of rollers 451 arrayed in the horizontal direction X and configured to contact the back surface M2 of the printing medium M, and the printing medium M conveyed from the descending conveyor 44 is supported below the color printing unit 32 by the plurality of rollers 451. In this way, the plurality of rollers 451 of the color conveyor 45 convey the printing medium M from the other side X2 toward the one side X1 while supporting the printing medium M from below by contacting the back surface M2 of the printing medium M conveyed from the descending conveyor 44 from below. Each discharge head 321 of the color printing unit 32 discharges the color ink to the front surface M1 of the printing medium M being conveyed along the front surface M1 by the color conveyor 45 from above.

At this time, the front surface M1 of the printing medium M being conveyed by the color conveyor 45 is facing upward, and the back surface M2 of the printing medium M is facing downward. In particular, the printing medium M is carried in through the carry-in port 311 with the front surface M1 thereof facing upward, and conveyed from the other side X2 toward the one side X1 by the carry-in part 41. The printing medium M passed through the carry-in part 41 is conveyed from the one side X1 toward the other side X2 by the upper conveyor 43 after being vertically inverted by the ascending conveyor 42 and the upper conveyor 43. Thus, the front surface M1 of the printing medium M being conveyed by the upper conveyor 43 is facing downward. The printing medium M passed through the upper conveyor 43 is conveyed from the other side X2 toward the one side X1 by the color conveyor 45 after being vertically inverted by the descending conveyor 44 and the color conveyor 45. Thus, the front surface M1 of the printing medium M being conveyed by the color conveyor 45 is facing upward.

Further, the conveyor 4 includes rollers 461, 462 configured to contact the printing medium M on a side upstream of the color conveyor 45 in the moving direction of the printing medium M. The roller 461 is a drive roller which drives the printing medium M, and the roller 462 is a driven roller having a tension sensor which detects a tension applied to the printing medium M. Such drive and driven rollers 461, 462 constitute a tension adjuster which adjusts a tension of the printing medium M together with a driven roller 472 having a tension sensor detecting the tension applied to be printing medium M, a drive roller 471 and a drive roller 491 to be described later. That is, each of the rollers 461, 471 and 491 rotates at a speed corresponding to the tension detected by the tension sensors of rollers 462 and 472, whereby the tension of the printing medium M being conveyed by the conveyor 4 is adjusted to a predetermined target tension over the entirety. In this way, the color inks and the white ink can be discharged to a printing medium while a suitable tension is given to the printing medium.

Further, the conveyor 4 includes an inverting conveyor 47 which vertically inverts the printing medium M conveyed to the one side X1 from the color conveyor 45 twice. This inverting conveyor 47 includes a plurality of the rollers 471, 472 arrayed in the vertical direction Z on the one side X1 of the color conveyor 45 and configured to contact the back surface M2 of the printing medium M. Out of the plurality of rollers 471, 472, the roller 471 on an upper end changes the moving direction of the printing medium M from the direction toward the one side X1 to the downward direction by bending the printing medium M conveyed from the color conveyor 45 downward, and the roller 472 on a lower end changes the moving direction of the printing medium M from the downward direction to the direction toward the other side X2 by bending the printing medium M conveyed from the roller 471 toward the other side X2. In this way, the printing medium M is vertically inverted by the rollers 471, 472 in contact with the back surface M2 of the printing medium M, whereby the back surface M2 of the printing medium M is facing upward and the front surface M1 of the printing medium M is facing downward.

Further, the inverting conveyor 47 includes a plurality of rollers 473 arrayed in the horizontal direction X below the color conveyor 45 and on the other side X2 of the roller 472 and configured to contact the back surface M2 of the printing medium M. These rollers 473 convey the printing medium M conveyed from the roller 472 from the one side X1 toward the other side X2. In this way, the printing medium M having the back surface M2 facing upward is conveyed from the one side X1 toward the other side X2 by the plurality of rollers 473 in contact with the back surface M2 of the printing medium M.

Furthermore, the inverting conveyor 47 includes a plurality of rollers 474, 476 and 477 arrayed in the vertical direction Z on the other side X2 of the plurality of rollers 473 and the descending conveyor 44 and configured to contact the back surface M2 of the printing medium M. Out of the plurality of rollers 474 to 477, the roller 474 on a lower end changes the moving direction of the printing medium M from the direction toward the other side X2 to the upward direction by bending the printing medium M conveyed from the plurality of rollers 473 upward, and the roller 477 on an upper end changes the moving direction of the printing medium M from the upward direction to the direction toward the one side X1 by bending the printing medium M conveyed from the roller 474 via the roller 476 toward the one side X1. In this way, the printing medium M is vertically inverted by the rollers 474 to 477 in contact with the back surface M2 of the printing medium M, whereby the front surface M1 of the printing medium M is facing upward and the back surface M2 of the printing medium M is facing downward.

Further, the inverting conveyor 47 includes a roller 478 arranged above the upper conveyor 43 and on the one side X1 of the roller 477 and configured to contact the back surface M2 of the printing medium M. The roller 478 conveys the printing medium M conveyed from the roller 477 from the other side X2 to the one side X1. In this way, the printing medium M having the front surface M1 facing upward is conveyed from the other side X2 toward the one side X1 by the roller 478 in contact with the back surface M2 of the printing medium M.

As just described, the inverting conveyor 47 conveys the printing medium M conveyed from the color conveyor 45 downward by the rollers 471, 472 and further conveys the printing medium M while changing the moving direction of the printing medium M to the direction toward the other side X2 by the roller 472, thereby vertically inverting the front surface M1 and the back surface M2 of the printing medium M. Subsequently, the inverting conveyor 47 conveys the printing medium M from the one side X1 toward the other side X2 by the plurality of rollers 473 and then conveys the printing medium M upward by the rollers 474 to 477. Further, the inverting conveyor 47 vertically inverts the front surface M1 and the back surface M2 of the printing medium M again by changing the moving direction of the printing medium M to the direction toward the one side X1 by the roller 477, and conveys the printing medium M from the other side X2 toward the one side X1 by the roller 478.

In this way, the inverting conveyor 47 vertically inverts the front surface M1 and the back surface M2 of the printing medium M twice only by the rollers 471 to 478 which are rotating with contacting the back surface M2 of the printing medium M having the back surface laid on the rollers 471 to 478. That is, the inverting conveyor 47 can vertically invert the front surface M1 and the back surface M2 of the printing medium M twice without providing supporting members such as rollers and air turn bars on the side of the front surface M1 of the printing medium M at all.

Further, the conveyor 4 includes a white conveyor 48 provided above the upper conveyor 43 and on the one side X1 of the roller 478 of the inverting conveyor 47. This white conveyor 48 includes a roller 481, and the printing medium M conveyed from the roller 478 of the inverting conveyor 47 is supported below the white printing unit 33 by the roller 481. In this way, the roller 481 of the white conveyor 48 conveys the printing medium M from the other side X2 toward the one side X1 while supporting the printing medium M from below by contacting the back surface M2 of the printing medium M conveyed from the roller 478 of the inverting conveyor 47 from below. The discharge head 331 of the white printing unit 33 discharges the white ink to the front surface M1 of the printing medium M being conveyed along the front surface M1 by the white conveyor 48 from above.

Furthermore, the conveyor 4 includes a carry-out part 49 provided above the upper conveyor 43 and on the one side X1 of the white conveyor 48. The carry-out part 49 includes a plurality of rollers 491, 492 and 493 arrayed in the horizontal direction X and configured to contact the back surface M2 of the printing medium M. The roller 491 is drive roller which drives the printing medium M, and the rollers 492, 493 rotate according to the conveyance of the printing medium M. In contrast, a carry-out port 312 is open in a side wall on the one side X1 of the housing 31, and the plurality of rollers 491 to 493 of the carry-out part 49 carry out the printing medium M through the carry-out port 312 by conveying the printing medium M from the other side X2 toward the one side X1 while contacting the back surface M2 of the printing medium M from below.

Further, the printing apparatus 3 includes a pre-dryer 34 arranged in the housing 31. The pre-dryer 34 is arranged between the carry-in part 41 and the inverting conveyor 47 in the vertical direction Z. This pre-dryer 34 includes a plurality of nozzles 341 arrayed in the moving direction of the printing medium M conveyed from the one side X1 toward the other side X2 by the plurality of rollers 473 of the inverting conveyor 47. Each nozzle 341 faces the front surface M1 of the printing medium M conveyed by the plurality of rollers 473 from below and injects air at a room temperature to the front surface M1 of this printing medium M from below. That is, the front surface M1 of the printing medium M, to which the color inks were discharged from the color printing unit 32, is dried by the pre-dryer 34.

Note that this pre-dryer 34 is not necessarily limited to the one between the carry-in part 41 and the inverting conveyor 47, and the arranged position of the pre-dryer 34 is not limited as long as such a positional relationship that air can be injected to the front surface M1 of the printing medium M being conveyed by the inverting conveyor 47 can be established. That is, this pre-dryer 34 can be so arranged that air can be injected to the front surface M1 of the printing medium M before the white ink is discharged to the front surface M1 of the printing medium M by the white printing unit 33 after the color inks are discharged to the front surface M1 of the printing medium M by the color printing unit 32. However, if this pre-dryer 34 is arranged between the carry-in part 41 and the inverting conveyor 47, a space below the inverting conveyor 47 can be utilized as an arrangement space for the pre-dryer, and there is a merit of being able to miniaturize the printing apparatus in the horizontal direction.

Further, the printing apparatus 3 includes an upper dryer 35 arranged in the housing 31. The upper dryer 35 is arranged above the carry-out part 49. This upper dryer 35 includes a plurality of nozzles 351 arrayed in the moving direction of the printing medium M being conveyed from the other side X2 toward the one side X1 by the carry-out part 49. Each nozzle 351 faces the front surface M1 of the printing medium M being conveyed by the carry-out part 49 from above, and injects air at a room temperature to the front surface M1 of this printing medium M from above. That is, the front surface M1 of the printing medium M, to which the white ink was discharged from the white printing unit 33, is dried by the upper dryer 35.

Furthermore, the printing apparatus 3 includes ink covers 51, 53 and 55 arranged in the housing 31. These ink covers 51, 53, 55 suppress the adhesion of the inks discharged from the discharge heads 321 (or the discharge head 331) in a mist state (i.e. ink mist) to the printing medium M. Each ink cover 51, 53, 55 is wider than the printing medium M in the Y direction equivalent to a width direction of the printing medium M (in other words, a direction orthogonal to the conveying direction of the printing medium M). That is, when viewed from a normal direction to the printing medium M, both ends of the printing medium M are located inwardly of both ends of each of the ink covers 51, 53, 55 in the Y direction. These ink covers 51, 53 and 55 are supported by the housing 31.

The ink cover 51 is provided to face the front surface M1 of the printing medium M before the discharge heads 321 of the color printing unit 32 discharge the inks to the printing medium M. This ink cover 51 includes a lower separation wall 511 provided for the printing medium M being conveyed in the X direction by the carry-in part 41. Specifically, the lower separation wall 511 is arranged between the printing medium M being conveyed from the one side X1 to the other side X2 of the color printing unit 32 (i.e. the plurality of discharge heads 321) by the inverting conveyor 47 (rollers 472 to 474) and the printing medium M being conveyed from the other side X2 to the one side X1 of the color printing unit 32 by the carry-in part 41 in the Z direction. This lower separation wall 511 is located below the color printing unit 32 and the color conveyor 45. The lower separation wall 511 extends from the other side X2 to the one side X1 of the color printing unit 32 in the X direction and faces the front surface M1 of the printing medium M being conveyed by the carry-in part 41 from above. In a bottom view from below in the Z direction, the lower separation wall 511 is arranged to overlap the plurality of discharge heads 321 of the color printing unit 32, in other words, these discharge heads 321 are concealed by the lower separation wall 511.

Further, the ink cover 51 includes a one-side separation wall 513 provided for the printing medium M being conveyed in the Z direction by the ascending conveyor 42. This one-side separation wall 513 is provided upward from an end on the one side X1 of the lower separation wall 511 and extends from the lower side of the color printing unit 32 and to the upper side of the color printing unit 32. Specifically, the one-side separation wall 513 is arranged between the printing medium M being conveyed from the lower side to the upper side of the color printing unit 32 by the ascending conveyor 42 and the color printing unit 32 in the X direction. The one-side separation wall 513 is located on the one side X1 of the color printing unit 32 and located on the one side X1 of the printing medium M being conveyed by the color conveyor 45 and the inverting conveyor 47. Such a one-side separation wall 513 faces the front surface M1 of the printing medium M being conveyed in the Z direction by the ascending conveyor 42 from the other side X2. In a side view from the one side X1 in the X direction, the one-side separation wall 513 is arranged to overlap the plurality of discharge heads 321 of the color printing unit 32, in other words, these discharge heads 321 are concealed by the one-side separation wall 513.

Further, the ink cover 51 includes an upper separation wall 515 provided for the printing medium M being conveyed in the X direction by the upper conveyor 43. This upper separation wall 515 is provided toward the other side X2 from the upper end of the one-side separation wall 513 and extends from the one side X1 to the other side X2 of the color printing unit 32. That is, the upper separation wall 515 is arranged between the printing medium M being conveyed from the one side X1 to the other side X2 of the color printing unit 32 by the upper conveyor 43 and the color printing unit 32 in the Z direction. The upper separation wall 515 extends from the one side X1 to the other side X2 of the color printing unit 32 in the X direction and faces the front surface M1 of the printing medium M being conveyed by the upper conveyor 43 from below. In a plan view from above in the Z direction, the upper separation wall 515 is arranged to overlap the plurality of discharge heads 321 of the color printing unit 32, in other words, these discharge heads 321 are concealed by the upper separation wall 515.

The ink cover 53 is provided to face the back surface M2 of the printing medium M before the discharge heads 321 of the color printing unit 32 discharges the inks to the printing medium M. This ink cover 53 includes an other-side separation wall 531 provided for the printing medium M being conveyed in the Z direction by the descending conveyor 44. In a side view from the other side X2 in the X direction, this other-side separation wall 531 is arranged to overlap and conceal the printing medium M being conveyed by the upper conveyor 43, the descending conveyor 44 and the color conveyor 45. Further, in a plan view from above in the Z direction, the other-side separation wall 531 is located on the one side X1 of the white printing unit 33 (i.e. discharge head 331). That is, the other-side separation wall 531 is provided on the other side X2 of the printing medium M being conveyed by the descending conveyor 44 and on the one side X1 of the white printing unit 33, and faces the back surface M2 of the printing medium M being conveyed by the descending conveyor 44 from the other side X2.

Further, the ink cover 53 includes an upper separation wall 533 provided for the printing medium M being conveyed in the X direction by the upper conveyor 43. This upper separation wall 533 is provided from the upper end of the other-side separation wall 531 toward the one side X1 in the X direction. In a plan view from above in the Z direction, this upper separation wall 533 is arranged to overlap and conceal the printing medium M being conveyed by the upper conveyor 43. Further, this upper separation wall 533 faces the printing medium M being conveyed in the X direction by the carry-out part 49 from below. That is, the upper separation wall 533 is provided between the printing medium M being conveyed by the carry-out part 49 and the printing medium M being conveyed by the upper conveyor 43 in the Z direction, and faces the back surface M2 of the printing medium M being conveyed by the upper conveyor 43 from above.

As just described, the ink cover 53 includes the other-side separation wall 531 and the upper separation wall 533. A part constituted by these other-side separation wall 531 and upper separation wall 533 overlaps the printing medium M being conveyed by the upper conveyor 43, the descending conveyor 44 and the color conveyor 45 and conceals this printing medium in the plan view from above in the Z direction and the side view from the other side X2.

Further, the ink cover 53 includes not only these separation walls 531, 533 facing the back surface M2 of the printing medium M before printing, but also a lower separation wall 535 facing the back surface M2 of the printing medium M during and after printing. Specifically, the lower separation wall 535 is provided between the printing medium M being conveyed in the X direction by the color conveyor 45 and the printing medium M being conveyed in the X direction by the inverting conveyor 47 (rollers 472 to 474) in the Z direction. This lower separation wall 535 faces the back surface M2 of the printing medium M being conveyed by the color conveyor 45 from below.

The ink cover 55 extends in parallel to the X direction and faces the discharge head 331 from below. That is, in a bottom view from below in the Z direction, the ink cover 55 is arranged to overlap the discharge head 331 and conceal this discharge head 331.

Figure 3:
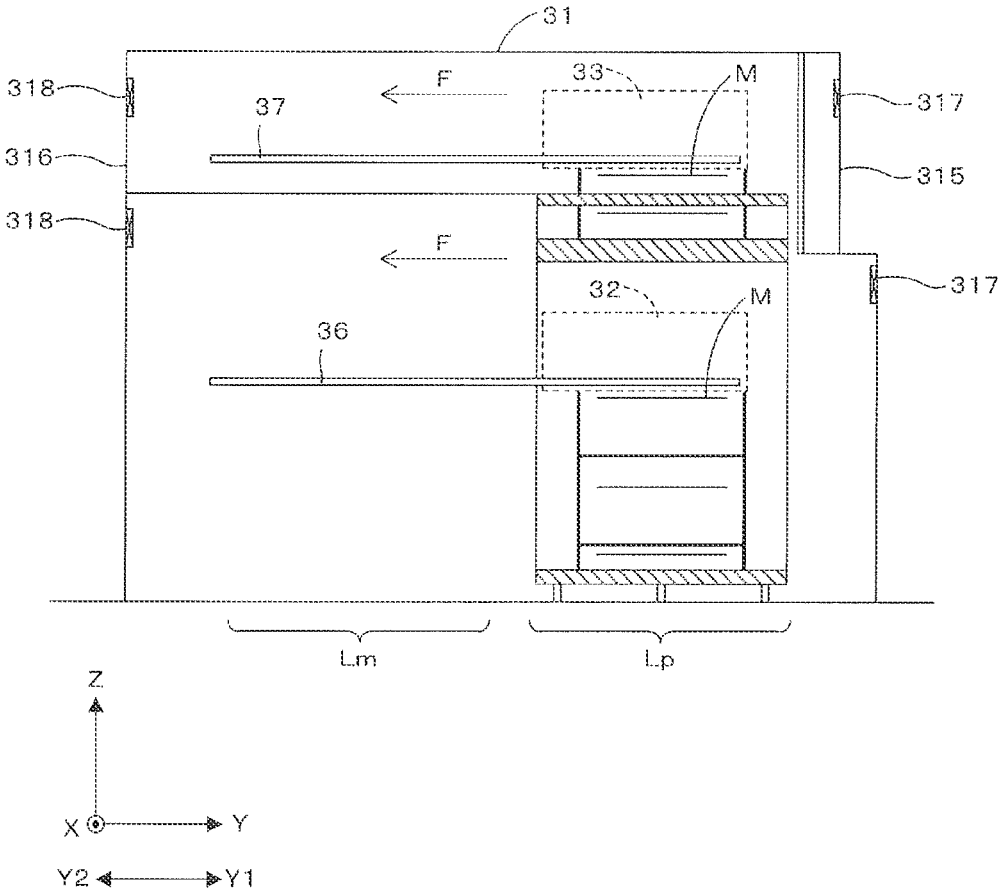
FIG. 3 is a side view schematically showing the printing apparatus of FIG. 2.

FIG. 3 is a side view schematically showing the printing apparatus of FIG. 2. In FIG. 3, a front side Y1 in the Y direction and a back side Y2 in the Y direction opposite to the front side Y1 are shown. As shown in FIG. 3, a printing position Lp and a maintenance position Lm provided on the back side Y2 of the printing position Lp are provided in the housing 31 of the printing apparatus 3. Each of the aforementioned color printing unit 32 and white printing unit 33 is supported movably in the Y direction (depth direction) between the printing position Lp and the maintenance position Lm.

That is, guide rails 36 extending in parallel to the Y direction from the printing position Lp to the maintenance position Lm are provided for the color printing unit 32. Specifically, a pair of the guide rails 36 provided in parallel while being spaced apart in the X direction are mounted in the housing 31, and both ends of the support frame 322 to support the color printing unit 32 are supported on the pair of guide rails 36. The color printing unit 32 is guided by the guide rails 36 according to the support frame 322 manually by an operator or by the drive of a motor, and moves between the printing position Lp and the maintenance position Lm. The color printing unit 32 located at the printing position Lp faces the front surface M1 of the printing medium M being conveyed by the conveyor 4 from above, whereas the color printing unit 32 located at the maintenance position Lm does not face this printing medium M.

Similarly, guide rails 37 extending in parallel to the Y direction from the printing position Lp to the maintenance position Lm are provided for the white printing unit 33. Specifically, a pair of the guide rails 37 provided in parallel while being spaced apart in the X direction are mounted in the housing 31, and both ends in the X direction of the white printing unit 33 (discharge head 331) are supported on the pair of guide rails 37. The white printing unit 33 is guided by the guide rails 37 manually by the operator or by the drive of a motor, and moves between the printing position Lp and the maintenance position Lm. The white printing unit 33 located at the printing position Lp faces the front surface M1 of the printing medium M being conveyed by the conveyor 4 from above, whereas the white printing unit 33 located at the maintenance position Lm does not face this printing medium M.

The housing 31 includes a wall 315 and a wall 316 rising while being spaced apart in the Y direction, and the printing position Lp and the maintenance position Lm are provided between the wall 315 on the front side Y1 and the wall 316 on the back side Y2. A plurality of air inlets 317 are open in the wall 315 on the front side Y1. As shown in FIG. 2, these air inlets 317 include the air inlets 317 facing the respective discharge heads 321 of the color printing unit 32 from the front side Y1 and the air inlet 317 facing the discharge head 331 of the white printing unit 33 from the front side Y1. The air inlets 317 facing the color printing unit 32 at least partially overlap the respective discharge heads 321 of the color printing unit 32 in a front view from the front side Y1. Further, the air inlet 317 facing the white printing unit 33 at least partially overlaps the discharge head 331 of the white printing unit 33 in a front view from the front side Y1.

Further, a plurality of exhaust fans 318 are mounted to correspond to the plurality of air inlets 317 on the wall 316 on the back side Y2. These exhaust fans 318 exhaust air in the housing 31 to the outside (back side Y2) of the housing 31. As a result, an air flow F is generated, the air along the air flow F flows in through the air inlets 3217 on the front side Y1 of the printing position Lp and the maintenance position Lm and is exhausted from the exhaust fans 318 on the back side Y2 of the printing position Lp and the maintenance position Lm. This air flow F passes through the printing position Lp and the maintenance position Lm from the front side Y1 toward the back side Y2 in the Y direction.

In the embodiment described above, an image is printed on the front surface M1 by discharging the inks to the front surface M from the discharge heads 321 (first head) facing the front surface M1 (recording surface) of the printing medium M from above. Thus, the inks discharged from the discharge heads 321 partially become mist to possibly produce ink mist. Accordingly, in this embodiment, the ink cover 51 (first cover) is arranged between the discharge heads 321 and the front surface M1 of the printing medium M before the discharge heads 321 discharges the inks to the printing medium M, i.e. the front surface M of the printing medium M before reaching the discharge heads 321. By providing the ink cover 51 for the front surface M1 of the printing medium M before printing in this way, the adhesion of the ink mist to this front surface M1 can be suppressed. As a result, the contamination of the front surface M1 of the printing medium M before printing with the ink mist can be suppressed.

The conveyor 4 includes the ascending conveyor 42, the upper conveyor 43, the descending conveyor 44 and the color conveyor 45 which conveys the printing medium M toward the discharge heads 321. The ascending conveyor 42 conveys the printing medium M from the lower side to the upper side of the discharge heads 321 on the one side X1 of the discharge heads 321. The upper conveyor 43 (first upper conveyor) conveys the printing medium M conveyed by the ascending conveyor 42 from the one side X1 to the other side X2 above the discharge heads 321. The descending conveyor 44 conveys the printing medium M conveyed by the upper conveyor 43 from the upper side to the lower side of the discharge heads 321 on the other side X2 of the discharge heads 321. The color conveyor 45 (first printing conveyor) conveys the printing medium M conveyed by the descending conveyor 44 from the other side X2 to the one side X1 of the discharge heads 321 below the discharge heads 321. At this time, the front surface M1 of the printing medium M conveyed by the ascending conveyor 42 is facing toward the other side X2, the front surface M1 of the printing medium M conveyed by the upper conveyor 43 is facing downward, the front surface M1 of the printing medium M conveyed by the descending conveyor 44 is facing toward the one side X1, and the front surface M1 of the printing medium M conveyed by the color conveyor 45 is facing upward. The discharge heads 321 discharge the inks to the front surface M1 of the printing medium M being conveyed by the color conveyor 45.

In such a configuration, the ink mist produced near the front surface M1 of the printing medium M facing the discharge heads 321 easily flows from the other side X2 toward the one side X1 according to the conveyance of the printing medium M by the color conveyor 45. On the other hand, the front surface M1 of the printing medium M being conveyed by the ascending conveyor 42 is present on the one side X1 of the discharge heads 321. For this, the ink cover 51 includes the one-side separation wall 513 provided between the printing medium M being conveyed by the ascending conveyor 42 and the discharge heads 321 in the X direction (horizontal direction). Thus, the adhesion of the ink mist to the front surface M1 of the printing medium M being conveyed by the ascending conveyor 42 can be suppressed by the one-side separation wall 513.

Further, the ink cover 51 includes the upper separation wall 515 (first upper separation wall) provided between the printing medium M being conveyed by the upper conveyor 43 and the discharge heads 321 in the Z direction. In such a configuration, it can be suppressed by the upper separation wall 515 that the ink mist produced by the discharge of the inks from the discharge heads 321 is diffused upward and adheres to the surface M1 of the printing medium M being conveyed by the upper conveyor 43 above the discharge heads 321.

Further, the conveyor 4 includes the carry-in part 41 (lower conveyor) which conveys the printing medium M carried in through the carry-in port 311 to the ascending conveyor 42. This carry-in part 41 conveys the printing medium M from the other side X2 to the one side X1 below the discharge heads 321. At this time, the front surface M1 of the printing medium M being conveyed by the carry-in part 41 is facing upward. For this, the ink cover 51 includes the lower separation wall 511 (first lower separation wall) provided between the printing medium M being conveyed by the carry-in part 41 and the discharge heads 321 in the Z direction. In such a configuration, it can be suppressed by the lower separation wall 511 that the ink mist produced by the discharge of the inks from the discharge heads 321 is diffused downward and adheres to the front surface M1 of the printing medium M being conveyed by the carry-in part 41 below the discharge heads 321.

Further, the discharge head 331 (second head) facing the front surface M1 of the printing medium M from above at a position higher than the discharge heads 321 is arranged on the other side X2 of the discharge heads 321. This discharge head 331 further discharges the ink to the front surface M1, to which the inks were discharged from the discharge heads 321. In such a configuration, the front surface M1 of the printing medium M before printing being conveyed toward the color conveyor 45 by the conveyor 4 is facing the side opposite to the discharge head 331, whereas the back surface M2 (non-recording surface) of the printing medium M is facing toward the discharge head 331. For this, the ink cover 53 (second cover) is arranged between the back surface M2 of the printing medium M and the discharge head 331. Thus, the adhesion of the ink mist produced by the discharge of the ink from the discharge head 331 to the back surface M2 of the printing medium M before printing can be suppressed by the ink cover 53.

Further, the ink cover 53 includes the other-side separation wall 531 provided on the other side X2 of the printing medium M being conveyed by the descending conveyor 44 and on the one side X1 of the discharge head 331, and the other-side separation wall 531 faces the printing medium M being conveyed by the descending conveyor 44 from the other side X2. In such a configuration, the adhesion of the ink mist produced by the discharge of the ink from the discharge head 331 to the back surface M2 of the printing medium M being conveyed by the descending conveyor 44 can be suppressed by the other-side separation wall 531.

Further, the ink cover 53 includes the lower separation wall 535 (second lower separation wall) facing the back surface M2 of the printing medium M being conveyed by the color conveyor 45 from below in the Z direction. In such a configuration, the adhesion of the ink mist to the back surface M2 of the printing medium M being conveyed by the color conveyor 45 can be suppressed by the lower separation wall 535.

Further, the conveyor 4 includes the white conveyor 48 (second printing conveyor) and the carry-out part 49 (second upper conveyor). The white conveyor 48 supports the printing medium M, to which the ink is discharged from the discharge head 331. Further, the carry-out part 49 conveys the printing medium M conveyed by the white conveyor 48 from the other side X2 to the one side X1 above the discharge heads 321. In such a configuration, the ink mist produced by the discharge of the ink from the discharge head 331 is possibly diffused toward the one side X1 along with the printing medium M being conveyed by the carry-out part 49. The back surface M2 of the printing medium M being conveyed by the upper conveyor 43 is present on the one side X1 of the discharge head 331. For this, the ink cover 53 includes the upper separation wall 533 (second upper separation wall) provided between the printing medium M being conveyed by the carry-out part 49 and the printing medium M being conveyed by the upper conveyor 43 in the Z direction. Thus, the adhesion of the ink mist diffused toward one side from the discharge head 331 to the back surface M2 of the printing medium M being conveyed by the upper conveyor 43 can be suppressed by the upper separation wall 533.

Further, the ink cover 55 (third cover) is provided which faces the discharge head 331 from below. In such a configuration, the downward diffusion of the ink mist produced by the discharge of the ink from the discharge head 331 can be suppressed by the ink cover 55.

Further, the color printing unit 32, the white printing unit 33, the conveyor 4 and the ink covers 51, 53 and 55 are housed in the housing 31. This housing 31 is provided with the exhaust fans 318. Thus, the air flow F flowing in the Y direction (depth direction) is generated by the exhaust fans 318 in the housing 31, and the ink mist is exhausted from the housing 31 by this air flow F. The adhesion of the ink mist to the printing medium M can be suppressed by exhausting the ink mist floating in the housing 31 of the printing apparatus 3 to the outside of the housing 31 in this way.

Further, the exhaust fans 318 are arranged on the back side Y2 in the Y direction with respect to the color printing unit 32, the white printing unit 33 and the conveyor 4. On the other hand, the air inlets 317 provided on the front side Y1 in the Y direction with respect to the color printing unit 32, the white printing unit 33 and the conveyor 4 are open in the housing 31. In such a configuration, the ink mist can be efficiently exhausted by efficiently generating the air flow F from the front side Y1 to the back side Y2 of the housing 31 in the Y direction.

Further, the air inlets 317 face the discharge heads 321, 331 from the front side Y1 in the Y direction. In such a configuration, the ink mist produced by the discharge of the inks from the discharge heads 321, 331 can be efficiently exhausted by the air flow F. Further, the discharge heads 321, 331 heated along with the discharge of the inks can be cooled by air flowing in through the air inlets 317.

Further, the guide rails 36, 37 which guide movements of the discharge heads 321, 331 are provided between the printing position Lp facing the printing medium M being conveyed by the conveyor 4 and the maintenance position Lm on the back side Y2 in the Y direction of the printing position Lp in the housing 31. The exhaust fans 318 are arranged on the back side Y2 in the Y direction of the maintenance position Lm. In such a configuration, intervals between the discharge heads 321, 331 and the exhaust fans 318 are secured in the Y direction. Thus, the air flow F near the discharge heads 321, 331 is rectified from the front side Y1 to the back side Y2 in the Y direction and the ink mist produced by the discharge of the inks from the discharge heads 321, 331 can be efficiently exhausted by the air flow F.

In the embodiment described above, the printing apparatus 3 corresponds to an example of a "printing apparatus" of the invention, the housing 31 corresponds to an example of a "housing" of the invention, the air inlets 317 corresponds to an example of an "air inlet" of the invention, the exhaust fans 318 correspond to an example of an "exhaust fan" of the invention, the discharge heads 321 correspond to an example of a "first head" of the invention, the discharge head 331 corresponds to an example of a "second head" of the invention, the guide rails 36 correspond to an example of a "head guide" of the invention, the conveyor 4 corresponds to an example of a "conveyor" of the invention, the carry-in part 41 corresponds to an example of a "lower conveyor" of the invention, the ascending conveyor 42 corresponds to an example of an "ascending conveyor" of the invention, the upper conveyor 43 corresponds to an example of a "first upper conveyor" of the invention, the descending conveyor 44 corresponds to an example of a "descending conveyor" of the invention, the color conveyor 45 corresponds to an example of a "first printing conveyor" of the invention, the inverting conveyor 47 corresponds to an example of an "inverting conveyor" of the invention, the white conveyor 48 corresponds to an example of a "second printing conveyor" of the invention, the carry-out part 49 corresponds to an example of a "second upper conveyor" of the invention, the ink cover 51 corresponds to an example of a "first cover" of the invention, the lower separation wall 511 corresponds to an example of a "first lower separation wall" of the invention, the one-side separation wall 513 corresponds to an example of a "one-side separation wall" of the invention, the upper separation wall 515 corresponds to an example of a "first upper separation wall" of the invention, the ink cover 53 corresponds to an example of a "second cover" of the invention, the other-side separation wall 531 corresponds to an example of an "other-side lower separation wall" of the invention, the upper separation wall 533 corresponds to an example of a "second upper separation wall" of the invention, the lower separation wall 535 corresponds to an example of a "second lower separation wall" of the invention, the ink cover 55 corresponds to an example of a "third cover" of the invention, the maintenance position Lm corresponds to an example of a "maintenance position" of the invention, the printing position Lp corresponds to an example of a "printing position" of the invention, the printing medium M corresponds to an example of a "printing medium" of the invention, the front surface M1 corresponds to an example of a "recording surface" of the invention, the back surface M2 corresponds to an example of a "non-recording surface" of the invention, the X direction corresponds to an example of a "horizontal direction" of the invention, the one side X1 corresponds to an example of "one-side" of the invention, the other side X2 corresponds to an example of "other side" of the invention, the Y direction corresponds to an example of a "depth direction" of the invention, the front side Y1 corresponds to an example of a "front side" of the invention, and the back side Y2 corresponds to an example of a "back side" of the invention.

Note that the invention is not limited to the embodiment described above and various changes other than the aforementioned ones can be made without departing from the gist of the invention. For example, the specific configuration of the ink cover 51 may be changed as appropriate. Thus, it is not essential to provide all of the one-side separation wall 513, the lower separation wall 511 and the upper separation wall 515 and any of these may be omitted.

Further, the specific configuration of the ink cover 53 may be changed as appropriate. Thus, it is not essential to provide all of the other-side separation wall 531, the upper separation wall 533 and the lower separation wall 535 and any of these may be omitted. Alternatively, it is also not essential to provide the ink cover 53.

Further, the specific configuration of the ink cover 55 may be changed as appropriate. Alternatively, it is also not essential to provide the ink cover 55.

Further, the arrangement of the color printing unit 32 and the number of the discharge head(s) 321 of the color printing unit 32 may be changed as appropriate.

Further, the arrangement of the white printing unit 33 and the number of the discharge head(s) 331 of the white printing unit 33 may be changed as appropriate.

Further, the specific configuration of the conveyor 4 may be changed as appropriate.

The invention is applicable to printing techniques in general for performing printing by discharging an ink to a printing medium.

As described above, the printing apparatus may be configured so that the conveyor includes: an ascending conveyor which conveys the printing medium from a lower side to an upper side of the first head on one side of the first head, out of the one side and other side opposite to the one side in a horizontal direction; a first upper conveyor which conveys the printing medium conveyed by the ascending conveyor from the one side to the other side above the first head; a descending conveyor which conveys the printing medium conveyed by the first upper conveyor from the upper side to the lower side of the first head on the other side of the first head; and a first printing conveyor which conveys the printing medium conveyed by the descending conveyor from the other side to the one side of the first head below the first head, the recording surface of the printing medium being conveyed by the ascending conveyor is facing toward the other side, the recording surface of the printing medium being conveyed by the first upper conveyor is facing downward, the recording surface of the printing medium being conveyed by the descending conveyor is facing toward the one side, the recording surface of the printing medium being conveyed by the first printing conveyor is facing upward, the first head discharges the ink to the recording surface of the printing medium being conveyed by the first printing conveyor, and the first cover includes a one-side separation wall provided between the printing medium being conveyed by the ascending conveyor and the first head in the horizontal direction.

In such a configuration, the conveyor includes the first printing conveyor which conveys the printing medium from the other side to the one side in the horizontal direction below the first head, and the first head discharges the ink to the recording surface of the printing medium being conveyed by the first printing conveyor. Further, the conveyor includes the ascending conveyor, the first upper conveyor and the descending conveyor to convey the printing medium before printing to the first printing conveyor. The ascending conveyor conveys the printing medium from the lower side to the upper side on the one side of the first printing conveyor, the first upper conveyor conveys the printing medium from the one side to the other side above the first printing conveyor, and the descending conveyor conveys the printing medium from the upper side to the lower side on the other side of the first printing conveyor. That is, the printing medium before printing reaches the first printing conveyor by successively passing through the ascending conveyor, the first upper conveyor and the descending conveyor. In such a configuration, ink mist produced near the recording surface of the printing medium facing the first head easily flows from the other side to the one side according to the conveyance of the printing medium by the first printing conveyor. On the other hand, the recording surface of the printing medium being conveyed by the ascending conveyor is present on the one side of the first head. For this, the first cover includes the one-side separation wall provided between the printing medium being conveyed by the ascending conveyor and the first head in the horizontal direction. Therefore, the adhesion of the ink mist to the recording surface of the printing medium being conveyed by the ascending conveyor can be suppressed by the one-side separation wall.

The printing apparatus may be configured so that the first cover further includes a first upper separation wall provided between the printing medium being conveyed by the first upper conveyor and the first head in a vertical direction. In such a configuration, it can be suppressed by the first upper separation wall that the ink mist produced by the discharge of the ink from the first head is diffused upward to adhere to the recording surface of the printing medium being conveyed by the first upper conveyor above the first head.

The printing apparatus may be configured so that the conveyor further includes a lower conveyor which conveys the printing medium from the other side to the one side below the first head, the ascending conveyor conveys the printing medium conveyed by the lower conveyor from a lower side to an upper side of the first head, the recording surface of the printing medium being conveyed by the lower conveyor is facing upward, and the first cover further includes a first lower separation wall provided between the printing medium being conveyed by the lower conveyor and the first head in a vertical direction. In such a configuration, it can be suppressed by the first lower separation wall that the ink mist produced by the discharge of the ink from the first head is diffused downward to adhere to the recording surface of the printing medium being conveyed by the lower conveyor below the first head.

The printing apparatus may further comprises: a second head arranged on the other side of the first head to face the recording surface of the printing medium at a position higher than the first head from above, the second head discharging an ink to the recording surface having the ink discharged thereto from the first head; and a second cover arranged between the non-recording surface of the printing medium being conveyed by the conveyor before the first head discharges the ink to the printing medium and the second head, wherein: the conveyor further includes: an inverting conveyor conveying the printing medium conveyed from the first printing conveyor downward, vertically inverting the recording surface and the non-recording surface of the printing medium by further conveying the printing medium with a moving direction of the printing medium changed to a direction toward the other side opposite to the one side, conveying the printing medium from the one side to the other side, subsequently conveying the printing medium upward, vertically inverting the recording surface and the non-recording surface of the printing medium again by changing the moving direction of the printing medium to a direction toward the one side opposite to the other side, and conveying the printing medium from the other side to the one side; and a second printing conveyor conveying the printing medium conveyed from the inverting conveyor toward the one side along the recording surface below the second head with the recording surface of the printing medium facing upward, and the second head discharges the ink to the recording surface of the printing medium being conveyed by the second printing conveyor. In such a configuration, the recording surface of the printing medium before printing being conveyed toward the first printing conveyor by the conveyor is facing toward a side opposite to the second head, whereas the non-recording surface of this printing medium is facing toward the second head. For this, the second cover is arranged between the non-recording surface of the printing medium and the second head. Therefore, the adhesion of ink mist produced by the discharge of the ink from the second head to the non-recording surface of the printing medium before printing can be suppressed by the second cover.

The printing apparatus may be configured so that the second cover includes an other-side separation wall provided on the other side of the printing medium being conveyed by the descending conveyor and on the one side of the second head and facing the printing medium being conveyed by the descending conveyor from the other side. In such a configuration, the adhesion of the ink mist produced by the discharge of the ink from the second head to the non-recording surface of the printing medium being conveyed by the descending conveyor can be suppressed by the other-side separation wall.

The printing apparatus may be configured so that the second cover further includes a second lower separation wall facing the non-recording surface of the printing medium being conveyed by the first printing conveyor from below in a vertical direction. In such a configuration, the adhesion of the ink mist to the non-recording surface of the printing medium being conveyed by the first printing conveyor can be suppressed by the second lower separation wall.

The printing apparatus may be configured so that the conveyor further includes a second upper conveyor which conveys the printing medium conveyed by the second printing conveyor from the other side to the one side above the first head, and the second cover further includes a second upper separation wall provided between the printing medium being conveyed by the second upper conveyor and the printing medium being conveyed by the first upper conveyor in a vertical direction. In such a configuration, there is a possibility that the ink mist produced by the discharge of the ink from the second head is diffused toward the one side along with the printing medium being conveyed by the second upper conveyor. For this, the adhesion of the ink mist diffused toward the one side from the second head to the non-recording surface of the printing medium being conveyed by the first upper conveyor can be suppressed by the second upper separation wall.

The printing apparatus may further comprise a third cover facing the second head from below. In such a configuration, the downward diffusion of the ink mist produced by the discharge of the ink from the second head can be suppressed by the third cover.

The printing apparatus may further comprise: a housing which houses the first head, the conveyor and the first cover; and an exhaust fan which generates an air flow flowing in a depth direction orthogonal to a conveying direction of the printing medium by the conveyor and a vertical direction in the housing to exhaust the ink in a mist state from the housing. In such a configuration, the adhesion of the ink mist to the printing medium can be suppressed by exhausting the ink mist floating in the housing of the printing apparatus to the outside of the housing.

The printing apparatus may be configured so that the exhaust fan is arranged on a back side in the depth direction with respect to the first head and the conveyor, and an air inlet provided on a front side in the depth direction with respect to the first head and the conveyor is open on the housing. In such a configuration, the ink mist can be effectively exhausted by efficiently generating an air flow from a front side to a back side of the housing in the depth direction.

The printing apparatus may be configured so that the air inlet is facing the first head from front in the depth direction. In such a configuration, the ink mist produced by the discharge of the ink from the first head can be efficiently exhausted by an air flow.

The printing apparatus may further comprise a head guide which guides a movement of the first head between a printing position facing the printing medium being conveyed by the conveyor and a maintenance position on the back side of the printing position in the depth direction, wherein: the exhaust fan is arranged on the back side of the maintenance position in the depth direction. In such a configuration, an interval between the first head and the exhaust fan is secured in the depth direction. Thus, an air flow near the first head is rectified from the front side to the back side in the depth direction and the ink mist produced by the discharge of the ink from the first head can be efficiently exhausted by an air flow.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A printing apparatus comprising:

a conveyor which conveys a printing medium in the form of a long strip having a recording surface and a non-recording surface opposite to the recording surface;

a first head facing the recording surface of the printing medium being conveyed by the conveyor from above, the first head discharging an ink to the recording surface; and a first cover arranged between the recording surface of the printing medium being conveyed by the conveyor before the first head discharges the ink to the printing medium and the first head, wherein the conveyor includes:

an ascending conveyor which conveys the printing medium from a lower side to an upper side of the first head on one side of the first head, out of the one side and other side opposite to the one side in a horizontal direction;

a first upper conveyor which conveys the printing medium conveyed by the ascending conveyor from the one side to the other side above the first head;

a descending conveyor which conveys the printing medium conveyed by the first upper conveyor from the upper side to the lower side of the first head on the other side of the first head; and a first printing conveyor which conveys the printing medium conveyed by the descending conveyor from the other side to the one side of the first head below the first head, wherein the recording surface of the printing medium being conveyed by the ascending conveyor is facing toward the other side, wherein the recording surface of the printing medium being conveyed by the first upper conveyor is facing downward, wherein the recording surface of the printing medium being conveyed by the descending conveyor is facing toward the one side, wherein the recording surface of the printing medium being conveyed by the first printing conveyor is facing upward, wherein the first head discharges the ink to the recording surface of the printing medium being conveyed by the first printing conveyor, and wherein the first cover includes a one-side separation wall provided between the printing medium being conveyed by the ascending conveyor and the first head in the horizontal direction.

2. The printing apparatus according to claim 1, wherein the first cover further includes a first upper separation wall provided between the printing medium being conveyed by the first upper conveyor and the first head in a vertical direction.

3. The printing apparatus according to claim 1, wherein:

the conveyor further includes a lower conveyor which conveys the printing medium from the other side to the one side below the first head, the ascending conveyor conveys the printing medium conveyed by the lower conveyor from a lower side to an upper side of the first head, the recording surface of the printing medium being conveyed by the lower conveyor is facing upward, and the first cover further includes a first lower separation wall provided between the printing medium being conveyed by the lower conveyor and the first head in a vertical direction.

4. The printing apparatus according to claim 1, further comprising:

a second head arranged on the other side of the first head to face the recording surface of the printing medium at a position higher than the first head from above, the second head discharging an ink to the recording surface having the ink discharged thereto from the first head; and a second cover arranged between the non-recording surface of the printing medium being conveyed by the conveyor before the first head discharges the ink to the printing medium and the second head, wherein:

the conveyor further includes:

an inverting conveyor conveying the printing medium conveyed from the first printing conveyor downward, vertically inverting the recording surface and the non-recording surface of the printing medium by further conveying the printing medium with a moving direction of the printing medium changed to a direction toward the other side opposite to the one side, conveying the printing medium from the one side to the other side, subsequently conveying the printing medium upward, vertically inverting the recording surface and the non-recording surface of the printing medium again by changing the moving direction of the printing medium to a direction toward the one side opposite to the other side, and conveying the printing medium from the other side to the one side; and a second printing conveyor conveying the printing medium conveyed from the inverting conveyor toward the one side along the recording surface below the second head with the recording surface of the printing medium facing upward, and the second head discharges the ink to the recording surface of the printing medium being conveyed by the second printing conveyor.

5. The printing apparatus according to claim 4, wherein the second cover includes an other-side separation wall provided on the other side of the printing medium being conveyed by the descending conveyor and on the one side of the second head and facing the printing medium being conveyed by the descending conveyor from the other side.

6. The printing apparatus according to claim 5, wherein the second cover further includes a second lower separation wall facing the non-recording surface of the printing medium being conveyed by the first printing conveyor from below in a vertical direction.

7. The printing apparatus according to claim 5, wherein:

the conveyor further includes a second upper conveyor which conveys the printing medium conveyed by the second printing conveyor from the other side to the one side above the first head, and the second cover further includes a second upper separation wall provided between the printing medium being conveyed by the second upper conveyor and the printing medium being conveyed by the first upper conveyor in a vertical direction.

8. The printing apparatus according to claim 4, further comprising a third cover facing the second head from below.

9. A printing apparatus comprising:

a conveyor which conveys a printing medium in the form of a long strip having a recording surface and a non-recording surface opposite to the recording surface;

a first head facing the recording surface of the printing medium being conveyed by the conveyor from above, the first head discharging an ink to the recording surface;

a first cover arranged between the recording surface of the printing medium being conveyed by the conveyor before the first head discharges the ink to the printing medium and the first head;

a housing which houses the first head, the conveyor and the first cover; and an exhaust fan which generates an air flow flowing in a depth direction orthogonal to a conveying direction of the printing medium by the conveyor and a vertical direction in the housing to exhaust the ink in a mist state from the housing.

10. The printing apparatus according to claim 9, wherein:

the exhaust fan is arranged on a back side in the depth direction with respect to the first head and the conveyor, and an air inlet provided on a front side in the depth direction with respect to the first head and the conveyor is open on the housing.

11. The printing apparatus according to claim 10, wherein the air inlet is facing the first head from front in the depth direction.

12. The printing apparatus according to claim 9, further comprising a head guide which guides a movement of the first head between a printing position facing the printing medium being conveyed by the conveyor and a maintenance position on a back side of the printing position in the depth direction, wherein:

the exhaust fan is arranged on the back side of the maintenance position in the depth direction.

13. A printing method comprising:

conveying, by a conveyor, a printing medium in the form of a long strip having a recording surface and a non-recording surface opposite to the recording surface; and discharging an ink to the recording surface from a first head facing the recording surface of the printing medium from above, wherein a first cover is arranged between the recording surface of the printing medium before the first head discharges the ink to the printing medium and the first head, wherein the conveyor includes:

an ascending conveyor which conveys the printing medium from a lower side to an upper side of the first head on one side of the first head, out of the one side and other side opposite to the one side in a horizontal direction;

a first upper conveyor which conveys the printing medium conveyed by the ascending conveyor from the one side to the other side above the first head;

a descending conveyor which conveys the printing medium conveyed by the first upper conveyor from the upper side to the lower side of the first head on the other side of the first head; and a first printing conveyor which conveys the printing medium conveyed by the descending conveyor from the other side to the one side of the first head below the first head, wherein the recording surface of the printing medium being conveyed by the ascending conveyor is facing toward the other side, wherein the recording surface of the printing medium being conveyed by the first upper conveyor is facing downward, wherein the recording surface of the printing medium being conveyed by the descending conveyor is facing toward the one side, wherein the recording surface of the printing medium being conveyed by the first printing conveyor is facing upward, wherein the first head discharges the ink to the recording surface of the printing medium being conveyed by the first printing conveyor, and wherein the first cover includes a one-side separation wall provided between the printing medium being conveyed by the ascending conveyor and the first head in the horizontal direction.

* * * * *